United States Patent [19]

Yatsu et al.

[11] Patent Number: 4,871,370

[45] Date of Patent: Oct. 3, 1989

[54] STABLE CRYSTALLINE CELLULOSE III POLYMORPHS

[75] Inventors: Lawrence Y. Yatsu, New Orleans; Timothy A. Calamari, Jr., Metairie; Ruth R. Benerito, New Orleans, all of La.

[73] Assignee: The United States of America as represented by the Secretary of the Agriculture, Washington, D.C.

[21] Appl. No.: 63,357

[22] Filed: Jun. 18, 1987

[51] Int. Cl.[4] ..... D06M 1/00

[52] U.S. Cl. ..... 8/116.1; 8/115.51; 162/102

[58] Field of Search ..... 8/116.1, 115.51; 162/102

[56] References Cited

FOREIGN PATENT DOCUMENTS 1136417 12/1968 United Kingdom .

OTHER PUBLICATIONS

Barry, A. J., Peterson, F. C., and King, A. J., "Interactions of Cellulose with Liquid Ammonia", J. Amer. Chem., Soc. 58, 333–337 (1936).

Clark, G. L. and Parker, E. A., "X-Ray Diffraction Study of the Action of Liquid Ammonia on Cellulose and Its Derivatives" J. Phys. Chem. 41, 777–786 (1937).

Calamari, T. A., Jr., Schreiber, S. P., Cooper, A. S., and Reeves, W. A., "Liquid Ammonia Modification of Cellulose in Cotton and Polyester/Cotton Textiles," Textile Chem. and Color. 3, 61–65 (1971).

*Primary Examiner*—Paul Lieberman
*Assistant Examiner*—John F. McNally
*Attorney, Agent, or Firm*—M. Howard Silverstein; Raymond C. Von Bodungen; John D. Fado

[57] ABSTRACT

Novel cellulosic fiber with improved resistance to abrasion and increased permeability to chemicals characterized by highly stable crystalline cellulose III and cellulose IV forms is disclosed. Cellulose is selected from either fiber, yarn, fabric, cotton, or mercerized cotton treated with ammonia vapors at from about ambient to 140° C. and from about 100 psi to 1700 psi for sufficient time to alter the interatomic planar distances and produce stable crystalline cellulose III polymorph. Crystalline cellulose III can also be immersed in ethylenediamine and then boiled in dimethylformamide to completely convert the III to cellulose IV.

6 Claims, No Drawings

STABLE CRYSTALLINE CELLULOSE III POLYMORPHS

BACKGROUND OF THE INVENTION (1) Field of the Invention

This invention relates to production of ammonia mercerized cellulose. More specifically, this invention relates to treating cellulose fiber with vapors of ammonia to produce stable cellulose III polymorphs.

(2) Description of Prior Art

Heretofore, cotton cellulose in fiber, yarn and fabric was subjected to a conventional pretreatment with aqueous NaOH of "mercerization" strength (15–23%) to convert the cellulose I crystalline lattice to the cellulose II crystalline lattice which is more permeable to chemical solutions used in subsequent treatments. Although complexes of ammonia and cellulose were reported as early as 1936 Barry, A. J., Peterson, F. C., and King, A. J., "Interactions of Cellulose with Liquid $NH_3$, J. Amer. Chem., Soc. 58, 333–337 (1936); and, Clark, G. L. and Parker, E. A., "X-Ray Diffraction Study of the Action of Liquid $NH_3$ on Cellulose and Its Derivatives," J. Phys. Chem. 41, 777–786 (1937), the treatment of cotton cellulose with ammonia was only of academic interest until 1968 when a British patent, J. & P. Coates Ltd., et al British Pat. No. 1,136,417, Dec. 11, 1968 issued and described the use of liquid ammonia ($NH_3$).

Interest by the textile industry in liquid $NH_3$ pretreatments of cotton increased when Gogek, C. J., Olds, W. F., Volko, E. I., and Shanley, E. S. "Effect of Preswelling on Durable-Press Performance of Cotton," Textile Res. J. 39, 543–547 (1969) reported that liquid $NH_3$ pretreatments improved wash-wear ratings and abrasion resistance of subsequently crosslinked cotton fabrics. However, all of the prior art teaches that the degree of conversion of cellulose I to a new crystalline lattice, cellulose III, depended upon the manner in which liquid $NH_3$ was removed, Calamari, T. A., Jr., Schreiber, S. P., Cooper, A. S., and Reeves, W. A., "Liquid Ammonia Modification of Cellulose in Cotton and Polyester/Cotton Textiles," Textile Chem. and Color. 3, 61–65 (1971).

Even under optimum conditions, only partial conversion of I to III was obtained when $NH_3$ was removed in the absence of water. In every case in the prior art, that part of the lattice partially converted to III reverted to Cellulose I or to decrystallized or amorphous cellulose when the product was immersed in water for subsequent chemical treatments as shown in Lewin, M. and Roldan, L. G., "The Effect of liquid Anhydrous Ammonia in the Structure and Morphology of Cotton Cellulose," J. Polym. Sci., 36, 213–229 (1971). All x-ray diffractograms published show only partial conversion to III even before contact with water and decrystallization to amorphous cellulose. Earlier work on the removal of $NH_3$ at extremely low temperatures (−196° C.) indicated a larger conversion to crystalline form III than when $NH_3$ was removed at room temperature as seen in Jung, H. Z., Benerito, R. R.. Berni, R. J., and Mitcham, D., "Effect of Low Temperatures on Polymorphic Structure of Cotton Cellulose," J. Applied Poly. Sci. 21, 1981–1988 (1977). However, these partial conversions to crystalline form III readily converted to Cellulose I in the presence of water again showing serious instability.

SUMMARY OF THE INVENTION

Novel cellulosic fiber with improved resistance to abrasion and increased permeability to chemicals characterized by highly stable crystalline cellulose III form is disclosed. Complete conversion to cellulose III has been obtained and this new, highly crystalline product, exhibits a remarkably highly stable III condition.

The primary objective is to provide a method for producing cellulosic products with improved physical characteristics of easy-care or permanent press cottons and particularly with respect to resistance to abrasive wear.

A second objective is to obtain a stable cellulose III polymorph.

A further objective is to react cellulose III with non-aqueous or organic solvents to convert III to cellulose IV completely.

A further objective is to convert cellulosic fibers from either open or closed cotton bolls, yarns, and fabrics which have been converted from cellulose I crystalline form to cellulose III crystalline and exhibit a highly stable III form.

As used in the specification and claims, the phrase "highly stable" in reference to cellulose III and IV means that the cellulose III and IV can be boiled in water for at least one hour without reconverting to cellulose I.

DETAILED DESCRIPTION OF THE PREFERRED EMBODIMENTS

In the preferred practice of this invention, cotton in fiber yarn, or fabric forms is treated with liquid ammonia vapors under pressure. In general, samples in a slack condition are subjected to liquid ammonia vapors in a Parr bomb that is kept at 25° C. and a pressure of 690 kPa (100 psi). Samples can be dried either at room temperature by placing in ambient conditions or by drying into a vacuum. Pressure can be increased to 12,000 kPa (1700 psi) and temperatures to 140° C. while cellulose is in the bomb. These conditions and subsequent drying into vacuum or into air result in complete conversion of cellulose to stable cellulose III polymorphs and immersion of these cellulose III polymorphs in water or aqueous media will not result in reconversion to native cellulose I form as always occurs with cellulose samples treated with liquid $NH_3$ by procedures such as those taught in the prior art. Cellulose III products of the preferred embodiments can be boiled for several hours in boiling water without being reconverted to cellulose I.

In the preferred embodiments of this invention, that part of cellulose in polymorph I form is entirely converted to polymorph III and does not alter the cellulose II polymorph which is present in cottons pretreated with 23% aqueous NaOH (conventionally mercerized cotton).

Cellulose III polymorph can also be completely converted to Cellulose IV polymorph by first immersing Cellulose III in ethylenediamine and then in dimethylformamide at its boiling point.

The nature of the product can be verified via x-ray diffractograms in which $2\theta$ gives interplaner distances. Data in Table I show $2\theta$ diffractometer angles for polymorphs I, II, III and IV of cellulose.

The following examples serve to illustrate the preferred embodiments but are not intended to limit the scope of the invention.

EXAMPLE 1

Native cotton fabric (cellulose I) was immersed in a small amount (sufficient to cover fabric) of liquid $NH_3$; evaporated in a Parr bomb at ambient temperature until the pressure within the bomb registered approximately 100 psi (690 kPa). Samples could be left in the bomb after pressure stabilized for periods varying from short time intervals (30 min) to 16 hours at 25° C. Pressure could be released either into a vacuum at 25° C. (Sample 6 Table II) or into ambient room conditions. Fabric could also be freed of $NH_3$ by drying at high temperatures 140° C. (Sample 7 Table II). Samples were subjected to textile testing and x-ray diffraction before and after treatments. Fabrics completely converted to III, as determined by x-ray diffractograms, (See Table II), showed no change in moisture contents or regain values as compared to native cotton, cellulose I (determined by ASTM procedures) (See Table III). Conditioned wrinkle recovery was slightly less than that of native cotton, but abrasion resistance, as measured by Stoll Flex tests, was increased by 115% and tearing strength, as measured by Elmendorf method, was increased by 10% (See Table III).

TABLE II-continued

X-ray Diffraction Angles of Cotton Treated with Ammonia

| Sample[1] | Temperatures °C.[2] Bomb Drying | Diffractometer Angle, 2θ[3] 101 | 10$\bar{1}$ | 002 |
|---|---|---|---|---|
| 5. Fibers | 140 | 25 | 11.6(35) br 15.5(20) | 20.7(100) sh22.2(40) |
| 6. Fabric | 25 | 25(vac) | 11.6(29) br 15.5(14) | 20.6(100) sh22.3(35) |
| 7. Fabric | 25 | 140 | 11.6(22) br 15.5(9) | 20.4(100) sh22.2(22) |
| 8. Fibers | 25 | 25(vac) | 11.6(37) br 15.5(17) | 20.6(100) sh22.3(44) |
| 9. Fibers | 25 | 140 | 11.7(33) br 15.5(15) | 20.6(100) sh22.2(39) |
| 10. Fabric | −37(open Dewar) | 25(vac) | 11.8(14) br 15.5(36) | br21.0(100) |

[1]All samples except (1) and (2) were purified, sample (1) was from freshly pickled unopened bolls, and sample (2) from unopened bolls after storage in 95% ethanol.
[2]Bomb temperature is maximum reached in Parr bomb and drying was by release of $NH_3$ at indicated temperature into ambient conditions or with a vacuum (vac) as indicated.
[3]Values in parentheses are normalized intensities; br is broad due to 101 and 10$\bar{1}$ planes in IV; sh is shoulder due to 002 planes in IV; other peaks are sharp.

TABLE III

| Sample | Abrasion Resistance stoll, flex, filing Cycles | Change, % | Conditioned Wrinkle recovery angles (W + F)° | Elmendorf tearing strength filling, mN | Moisture content % | Moisture regain % |
|---|---|---|---|---|---|---|
| 1. Fibers | — | — | — | — | — | — |
| 2. Fibers | — | — | — | — | — | — |
| 3. Fibers | — | — | — | — | — | — |
| 4. Fabric | 1017 | +113 | 186 | 8066 | 5.60 | 5.19 |
| 5. Fibers | — | — | — | — | — | — |
| 6. Fabric | 1050 | +120 | 190 | 9005 | 5.50 | 5.20 |
| 7. Fabric | 1040 | +117 | 185 | — | — | — |
| 8. Fibers | — | — | — | — | — | — |
| 9. Fibers | — | — | — | — | 5.48 | 5.68 |
| 10. Fabric | — | — | — | — | — | — |
| 11. Fabric (native cotton control) | 477 | — | 235 | 7321 | 5.48 | 5.10 |

[1]Samples same as in Table II.

TABLE I

Polymorphic Forms of Cotton Cellulose[1]

| Samples | Polymorph | Diffractometer Angles, 2θ 101 | 10$\bar{1}$ | 002 | |
|---|---|---|---|---|---|
| 1. Cotton | Cellulose I | 14.6 | 16.4 | 22.6 | |
| 2. Mercerized | Cellulose I & II | 12.0 | 20.0 | 21.5 | |
| 3. Liquid $NH_3$ | Cellulose III | 11.7 | | 20.6 | |
| 4. Ethylenediamine | Cellulose IV | 15.5 | | 22.4 | |
| 5. (3) treated as (4) | Cellulose IV | 15.5 | | 22.3 | |
| 6. (2) treated as (3) | Cellulose II & III | 11.8 | | 20.5 | 21.2 |

[1]Sample (1) is purified cotton silver; Sample (2) is Sample (1) after conventional mercerization with aqueous 23% NaOH; Sample (3) is Sample (1) treated with liquid ammonia in a Parr bomb with ammonia removed at or above the critical point to produce Cellulose III; Sample (4) is Sample (1) treated with ethylenediamine.

TABLE II

X-ray Diffraction Angles of Cotton Treated with Ammonia

| Sample[1] | Temperatures °C.[2] Bomb Drying | Diffractometer Angle, 2θ[3] 101 | 10$\bar{1}$ | 002 |
|---|---|---|---|---|
| 1. Fibers | 140 | 140 | 11.5(24) br 15.5(9) | 20.6(100) sh22.2(32) |
| 2. Fibers | 140 | 140 | 11.5(22) br 15.5(9) | 20.6(100) sh22.3(29) |
| 3. Fibers | 140 | 140 | 11.6(25) | 20.6(100) |
| 4. Fabric | 140 | 140 | 11.6(22) br 15.5(9) | 20.5(100) sh22.3(22) |

EXAMPLE 2

The techniques of Example 1 were employed except that the temperature of the bomb was increased above the critical temperature of $NH_3$ which is (132.5° C.) with a resultant increase in bomb pressure to 1700 psi (12,000 kPa). Samples were dried at room temperature or above the critical temperature of ammonia. X-ray diffractograms showed 100% conversion to Cellulose III polymorphs (Samples 4 and 5 of Table II).

EXAMPLE 3

The technique of Example 1 was applied except that the samples were purified yarns or fibers rather than purified fabrics. The x-ray diffractograms showed excellent conversion of cellulose I to cellulose III (samples 3 and 9 of Table II). The cellulose III formed by this technique was highly crystalline III and remained III even after immersion in boiling water for several hours.

In contrast, even fibrous cellulose I treated with liquid $NH_3$ using prior art methods was only partially converted to cellulose III that disappeared as soon as the fibers were immersed in water at room temperature or exposed to moist air for several hours.

EXAMPLE 4

Techniques of Example 2 were employed except that fibers from unopened cotton bolls were used and samples were dried at 140° C. into a vacuum. The x-ray diffractograms showed that these samples not purified or pretreated were 100% converted to cellulose III (samples 1 and 2 of Table II) and that a pre-purification of the fibers to remove waxes was not required to convert cellulose I polymorph to cellulose III stable polymorph.

We claim:

1. A process for producing cellulosic fiber with improved resistance to abrasion and increased permeability to chemicals comprising: treating cellulosic fiber with ammonia vapors for sufficient time at a temperature from about ambient to about 140° C. and at a pressure from about 100 psi to about 1700 psi to sufficiently alter the interatomic planar distances to produce a highly stable crystalline cellulose III polymorph.

2. The process of claim 1 wherein the cellulosic fiber is selected from the group consisting of fiber, fabric, yarn, cotton balls, native cotton and mercerized cotton.

3. The process of claim 1 including immersing the highly stable crystalline cellulose III polymorph in ethylenediamine and then in dimethylformamide at its boiling point to completely convert said cellulose III to cellulose IV.

4. The process of claim 3 wherein the cellulosic fiber is selected from the group consisting of fiber, fabric, yarn, cotton balls, native cotton and mercerized cotton.

5. The process of claim 1 and including: immersing the cellulosic fiber in liquid ammonia in a bomb; and, evaporating the liquid ammonia in the bomb to said pressure and said temperature.

6. The process of claim 5 and including: releasing said pressure; and, drying the cellulosic fiber.

* * * * *